US006027359A

United States Patent [19]

Aoki et al.

[11] Patent Number: 6,027,359

[45] Date of Patent: Feb. 22, 2000

[54] STRUCTURE FOR PREVENTING LOOSENESS OF AN ELECTRICAL CONNECTOR

[75] Inventors: Hiroshi Aoki; Motohisa Kashiyama, both of Shizuoka, Japan

[73] Assignee: Yazaki Corporation, Tokyo, Japan

[21] Appl. No.: 08/943,137

[22] Filed: Oct. 3, 1997

[30] Foreign Application Priority Data

Oct. 7, 1996 [JP] Japan ..... 8-265916

[51] Int. Cl.[7] ..... H01R 13/627

[52] U.S. Cl. ..... 439/357

[58] Field of Search ..... 439/346, 350, 439/351–357

[56] References Cited

U.S. PATENT DOCUMENTS 5,254,014 10/1993 Yagi et al. ..... 439/353

FOREIGN PATENT DOCUMENTS 2 422 313 5/1974 Germany .

3600523 A1 7/1986 Germany .

60-77 1/1985 Japan .

*Primary Examiner*—Steven L. Stephan

*Assistant Examiner*—Eugene G. Byrd

*Attorney, Agent, or Firm*—Finnegan, Henderson, Farabow, Garrett & Dunner, L.L.P.

[57] ABSTRACT

A structure for preventing looseness of an electrical connector comprises a first connector housing, a second connector housing having a hood for accommodating the first connector housing, a locking projecting portion mounted on a locking arm which is formed at the first connector housing, and a locking hole formed at the hood so as to be engaged with the locking projecting portion. The first connector housing and the second connector housing are coupled with each other wherein the locking projection has taper portions so as to become progressively smaller in projecting direction of a main body like a square pole at both side walls locating in the coupling direction. A spacing between both lower edges of said taper portions is set to be approximately equal to a spacing between both inner wall surfaces locating in an orthogonal direction to coupling direction at the locking hole.

5 Claims, 6 Drawing Sheets

STRUCTURE FOR PREVENTING LOOSENESS OF AN ELECTRICAL CONNECTOR

BACKGROUND OF THE INVENTION

1. Field of the Invention

The present invention relates to a structure for preventing an electrical connector from loosening, when a connector housing and a mating connector housing are engaged mutually.

2. Description of the Prior Art

By engaging mutually a male connector and a female connector to provide an electrical connector in which terminals are electrically connected with each other. There has been proposed an electrical connector 50 shown in FIG. 8.

As shown in FIG. 8, this electrical connector 50 is formed by coupling a male connector 51 and a female connector 52 mutually and engaging with a locking mechanism whereby a locking arm 53 is raised from the male connector 51 and a locking hole 53*a* is formed in the locking arm 53. An engaging frame 54 is formed at the female connector 52, and a locking projection 54*a* (FIG. 9) to be engaging with the locking hole 53*a* is mounted on the engaging frame 54. And, by coupling the male connector 51 and the female 52 with each other, the locking hole 53*a* and the locking projection 54*a* are engaged, and then terminals (not shown) in both connectors 51, 52 are electrically connected with each other.

However, when coupling the male connector 51 and the female 52 with each other, there has been a fault of poor inserting performance because of the fact that each connector is connected with a mating connector directly and electrically. Therefore, such as an electrical connector shown in FIG. 10 has been proposed for providing better inserting performance when coupling the male and female connectors.

In FIG. 10, this electrical connector 60 comprises a male connector 61 and a female connector 62 having a hood 63 for accommodating the male connector 61. The male connector 61 and the female connector 62 are coupled with each other by means of a locking mechanism. A locking arm 64 is raised from the male connector 61, and a locking hole 64*a* is formed at the locking arm 64. A securing projection 65 is mounted on the hood 63. For providing better inserting performance at a time of coupling the male connector 61 and the female connector 62, a width "a" of the securing hole 64*a* is set longer than a width "b" (<a) of the securing projection 65, and a spacing "c" of both side wall surfaces 61*a*, 61*a* of the male connector 61 is made shorter than a spacing "d" (>c) of both inner side wall surfaces 63*a*, 63*a* of the hood 63.

However, while a performance of coupling the male connector 61 and the female connector 62 becomes better, the male connector 61 becomes easier in loosening within the female connector 62. And, there is a drawback such that, by the looseness between the male connector 61 and the female connector 62, the terminals therein are poorly electrically connected.

Therefore, for preventing looseness of both connectors when coupling, a locking mechanism formed at an electrical junction box as shown in FIG. 11 is proposed.

In FIG. 11, in this locking mechanism, a projecting length "e" of the securing projection 65 mounted on the hood 63 is made short. So, a performance of inserting the securing projection 65 into the securing hole 64 is improved when coupling.

However, as a projecting length "e" becomes short, there is a drawback such that a holding force between the male connector 61 and the female connector 62 (referring to FIG. 10) is weakened after coupling.

SUMMARY OF THE INVENTION

An object of the present invention is to provide a structure for preventing looseness of an electrical connector from causing, wherein the looseness of both connector housings when coupling a connector housing with a mating connector, and a holding force between both connector housings is not weakened after coupling.

According to the present invention, since a locking projection has such a taper portion as to become progressively smaller in a projecting direction thereof and there is not gap between a lower edge and an inner wall surface which locates in an orthogonal direction to a coupling direction, when a first connector housing and a second connector housing are coupled, there dose not cause the looseness between the locking projection and the locking hole in the orthogonal direction to the coupling direction. So, when both connector housings are coupled in such a state that a center line of the first connector housing accords with a center line of the second connector housing, the looseness between the locking projection and the locking hole is prevented to be causing.

The difference in a spacing between both upper edges and between both lower edges becomes greater than the difference in a spacing between both outer wall surfaces locating in the coupling direction of the first connector housing, and between both inner wall surfaces of the hood, each of which locates on opposite side, so even if the first or second connector housing is inserted on either side within a mating connector housing, the looseness between the locking projection and the locking hole is not caused in the orthogonal direction to the coupling direction. Therefore, when both connector housings are coupled in such a state that a center line of the first connector housing disaccords with a center line of the second connector housing, the looseness between the locking projection and the locking hole is prevented from causing.

In addition, backwardly divergent inserting guides in cross section at both inner wall surfaces of the hood, both inner wall surfaces which locates on opposite side to projecting side of the locking projection, are formed so as to be able to slide the locking projection, and a spacing between both inner wall surfaces of the locking hole in the orthogonal direction is set to be approximately equal to a spacing between both outer wall surfaces of the locking projection in the orthogonal direction. So, while the first connector housing and the second connector housing are coupled, there dose not cause the looseness between the locking projection and the locking hole in the orthogonal direction. Therefore, if, instead of forming the taper portions at the locking projection, backwardly divergent inserting guides in cross section are formed at both inner wall surfaces of the hood, this does not cause the looseness between the locking projection and the locking hole.

Since, when coupling both connector housing, the looseness which previously caused between the locking projection and the locking hole is prevented from causing, that a holding force becomes weak for causing the looseness after coupling both connector housings ,and thereby that terminals inserted into both connector housings are contacted imperfectly and electrically with each other are prevented respectively.

BRIEF DESCRIPTION OF THE DRAWING

The above and further objects and novel features of the invention will fully appear from the following detailed description when the same is read in connection with the accompanying drawing. It is to be expressly understood, however, that the drawing is for purpose of illustration only and is not intended as a definition of the limits of the invention.

DESCRIPTION OF THE PREFERRED EMBODIMENTS

Referring to the Figures, a preferred embodiment of the present invention will be described below.

FIG. 1 through FIG. 7 shows the first embodiment about the structure for preventing looseness of an electrical connector. Detailed explanation of the same structural member as the conventional embodiment will be omitted below.

Figure 1:
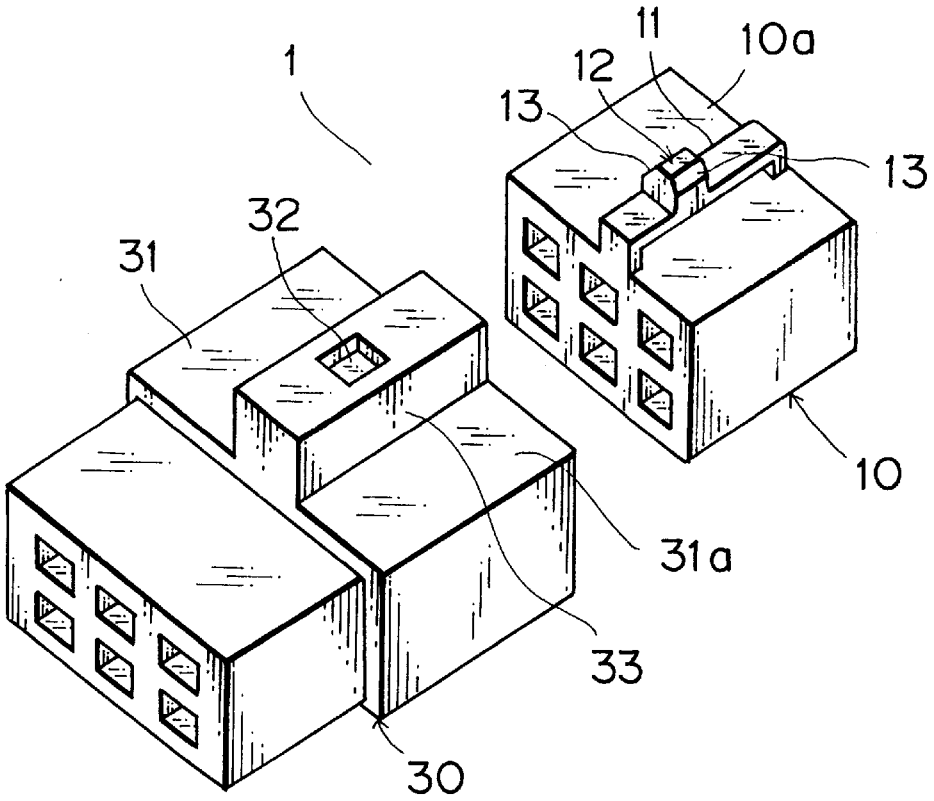
FIG. 1 is an exploded perspective view which shows the first embodiment about the structure for preventing looseness of an electrical connector.

In FIG. 1, this structure for preventing looseness of an electrical connector 1 includes a male connector housing 10 (called a male housing below) to provide a first connector housing, and a female connector housing (called a female housing below) to provide a second connector housing 30. A locking projection 12 is mounted on a locking arm 11 which is formed at the male housing 10, a locking hole 32 is formed at a hood 31 which is projected at the female housing 30, and taper portions 13, 13 for preventing from loosening is formed on the locking projection 12.

The male housing 10 has a locking arm 11 being sustained on both sides as well as extending in a coupling direction at an upper wall surface 10*a*, and a locking projection 12 being mounted as well as projecting upper on the locking arm 11.

Figure 2:
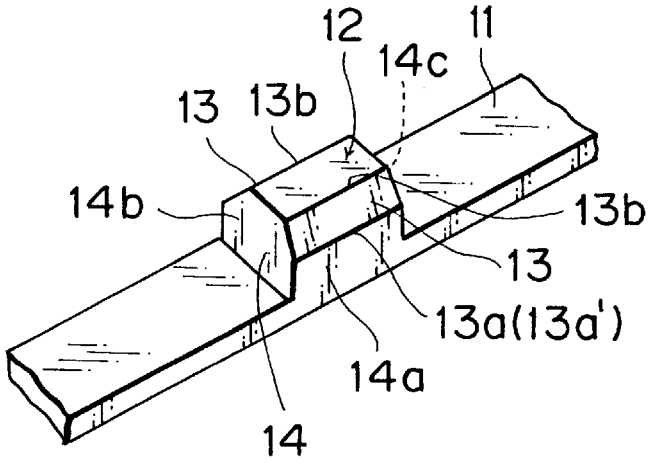
FIG. 2 is a grossly enlarged perspective view of a locking projection.

The locking projection 12, as shown in FIG. 2, is located at approximately center of the locking arm 11, and has a main body like a square pole as well as taper portions 13, 13. The main body is formed at the approximately same width as a width of the locking arm 11. The taper portions 13, 13 are located at both side walls 14*a*, 14*a* on a coupling side of the main body 14 and formed so as to become progressively smaller in projecting direction of the main body 14. A front wall surface 14*b* and a back wall surface 14*c* of the main body 14 are flatly formed. In addition, the front wall surface 14*b* of the main body 14 is preferably inclined because a inserting force for coupling the male housing 10 and the female housing 30 becomes weak.

As shown in FIG. 1, the female housing 30 has a hood 31 for accommodating the male housing 10, an accommodating room 33 located at an upper wall surface 31*a* of the hood 31 for accommodating the locking arm 11, and a locking hole 32 engaged with the locking projection 12 as well as formed at the accommodating room 33. In addition, it is also possible to form the locking hole 32 at the upper wall surface 31*a* of the hood 31.

Figure 3:
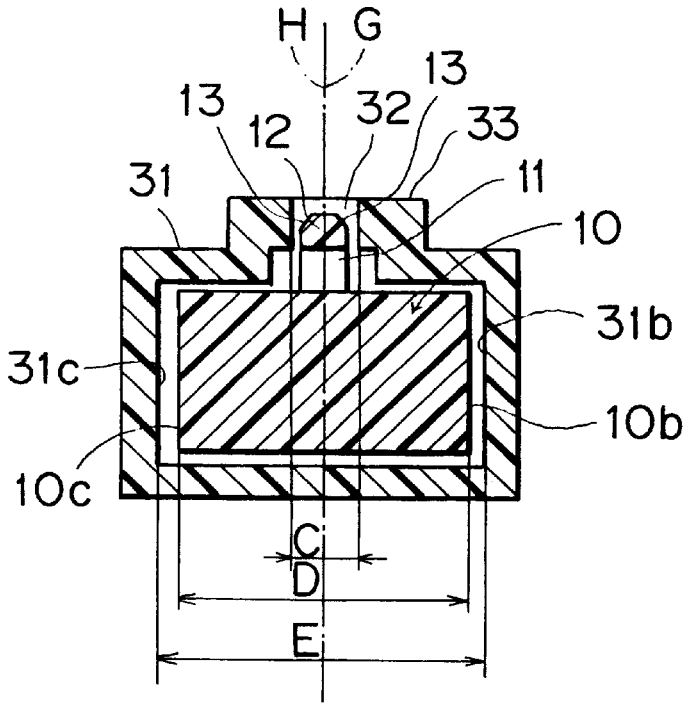
FIG. 3 is a cross-sectional view which shows the state that a male connector and a female connector are coupled and then a locking projection and a locking hole are engaged.
Figure 4:
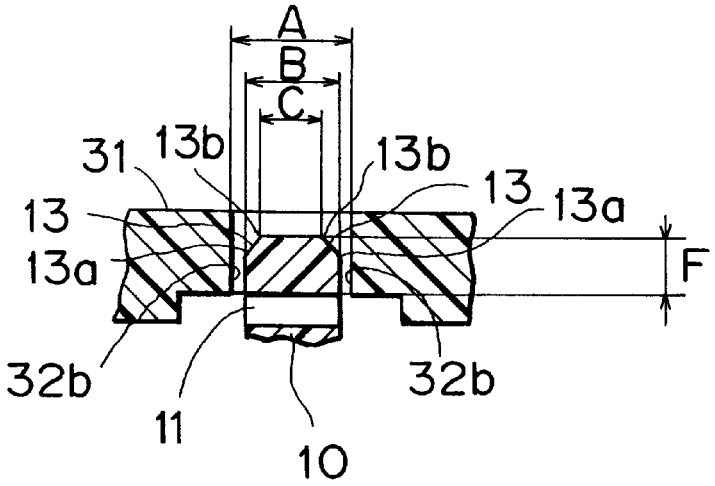
FIG. 4 is an enlarged view which shows the state that the locking projection and the locking hole are engaged.

And, as shown in FIGS. 3 and 4, a spacing "A" is set to be the approximately same length as a spacing "B" (that is, A≈B) as well as a difference (A−C) between the spacing "A" and a spacing "C" becomes greater than a difference (E−D) between a spacing "E" and a spacing "D" (that is, (E−D)< (A−C) ), wherein the spacing "A" is a length between both inner wall surface 32*b*, 32*b* of the locking hole 32 in an orthogonal direction to a coupling direction, the spacing "B" is a length between lower edges 13*a*, 13*a* of both taper portions 12, 12 (that is, a width of the locking hole 12 in the orthogonal direction), the spacing "C" is a length between upper edges 13*b*, 13*b* of both taper portions 13, 13 in the locking projection 12, and the spacing "D" is a length between both outer wall surfaces 10*c*, 10*c* of the male housing 10 on the coupling side.

Therefore, since the spacing "A" is approximately equal to the spacing "B", when inserting the male housing 10 into the female housing 30, there dose not cause the looseness between the locking projection 12 and the locking hole 32. And, since the spacing "E" becomes greater than the spacing "D", an inserting performance of inserting the male housing 10 into the female housing 30 is improved. That is, the inserting force diminishes. In addition, the taper portions 13, 13 are formed at both side walls 14*a*, 14*a* of the locking projection 12, but since a length "F" of the main body 14 projecting from the locking projection 12 is not transformed, when the locking projection 12 and the locking hole 32 are engaged, the holding force between the locking projection 12 and the locking hole 32 does not become weak.

Next, after inserting the male housing 10 into the female housing 30, when the locking projection 12 and the locking hole 32 are perfectly engaged, a movement about the locking projection 12 will be described; (1) when a center line G of the hood 31 accords with a center line H of the male housing 10.

Figure 5:
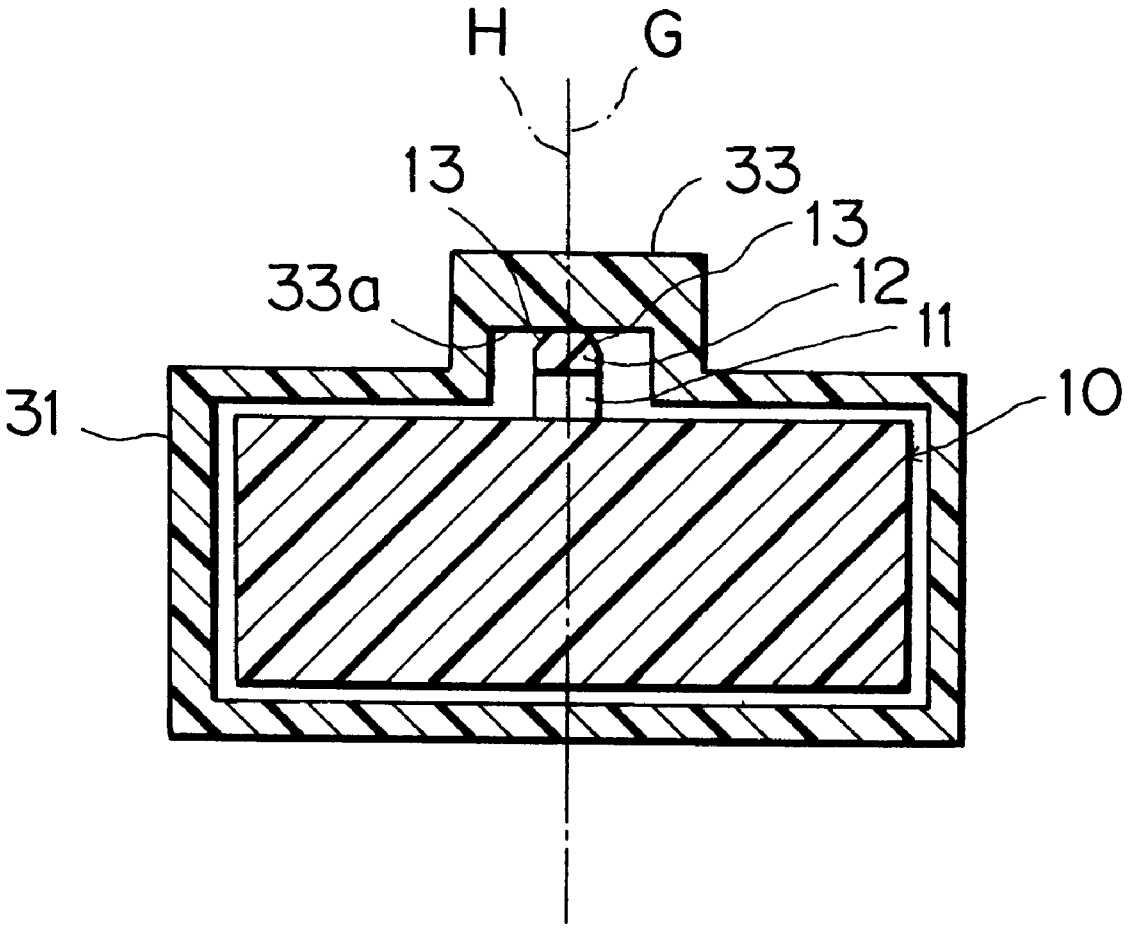
FIG. 5 is a cross-sectional view which shows the state before the locking projection and the locking hole are engaged when a center line of the male connector housing accords with a center line of the female connector.

As shown in FIG. 5, when the male housing 10 is inserted into the female housing 30, the locking projection 12 collides with the accommodating room 33, and the locking arm 11 is made to flex downward. In a bending state of the locking arm 11, a tip of the locking projection 12 slides on a ceiling surface 33*a* of the accommodating room 33. As the locking projection 12 begins to enter into the locking hole 32, the locking arm 11 is restored until becoming the former condition, and then ,as shown in FIG. 3, the locking projection 12 and the locking hole 32 are perfectly engaged. Besides, terminals (not shown) inserted into both male housing 10 and female housing 30 is electrically connected with each other. (2) when the center line G discords with the center line H (for example, the center line H is located on the right-hand side of the center line G).

Figure 6:
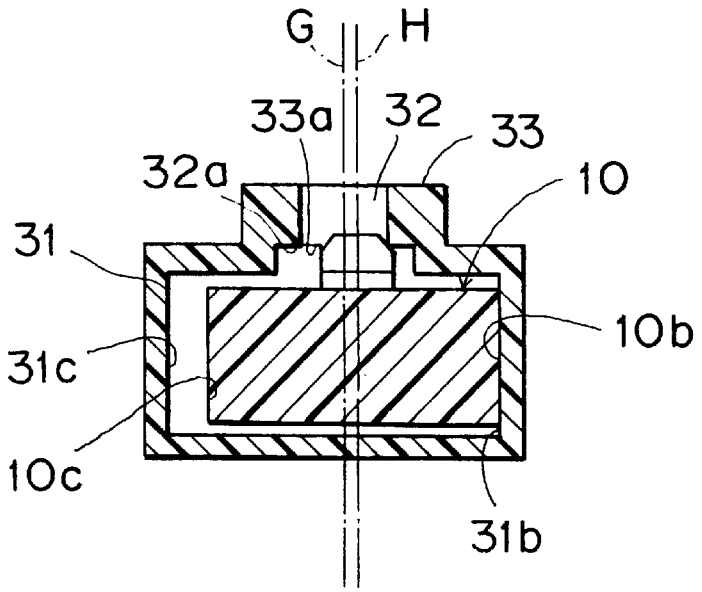
FIG. 6 is a cross-sectional view which shows the state after the locking projection and the locking hole when the center line of the male connector discords with a center line of the female connector.

As shown in FIG. 6, when the male housing 10 is inserted into the female housing 30 so that the right-hand outer wall surface 10*b* of the male housing 10 contacts to the right-hand inner wall surface 31*b* of the hood 31, the right-hand taper portion 13*a'* of the locking projection 12 collides with an opening edge 32*a* of the accommodating room 33. Since the right-hand taper 13*a'* is pushed by the opening edge 32*a*, the locking arm 11 inclines downward, and then is made to flex. As the locking projection 12 is inserted along the ceiling surface 33*a* of the accommodating room 33, the locking projection 12 enters in the locking hole 32 and the locking arm 11 is restored until becoming the former condition. And, the locking projection 12 and the locking hole 32 are engaged.

Figure 7:
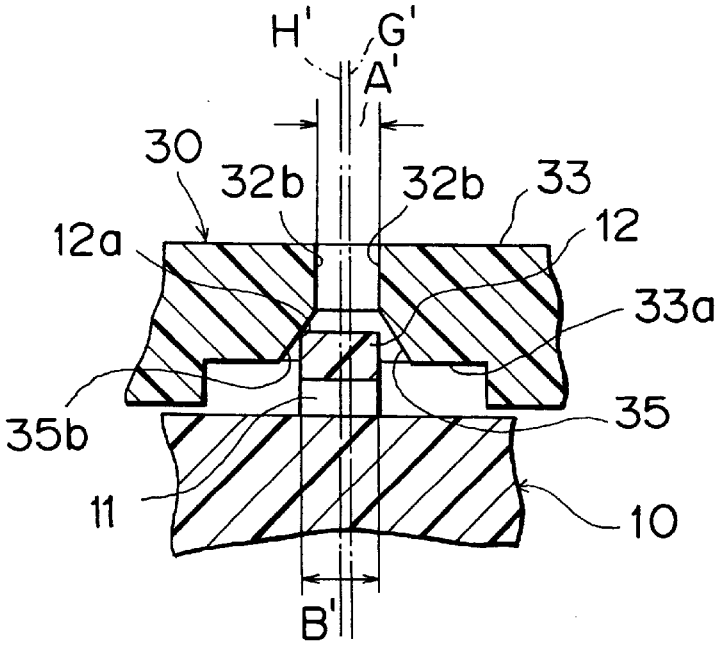
FIG. 7 is a cross-sectional view which shows the second embodiment about the structure for preventing looseness of an electrical connector at the state before a locking projection and a locking hole are engaged.
Figure 8:
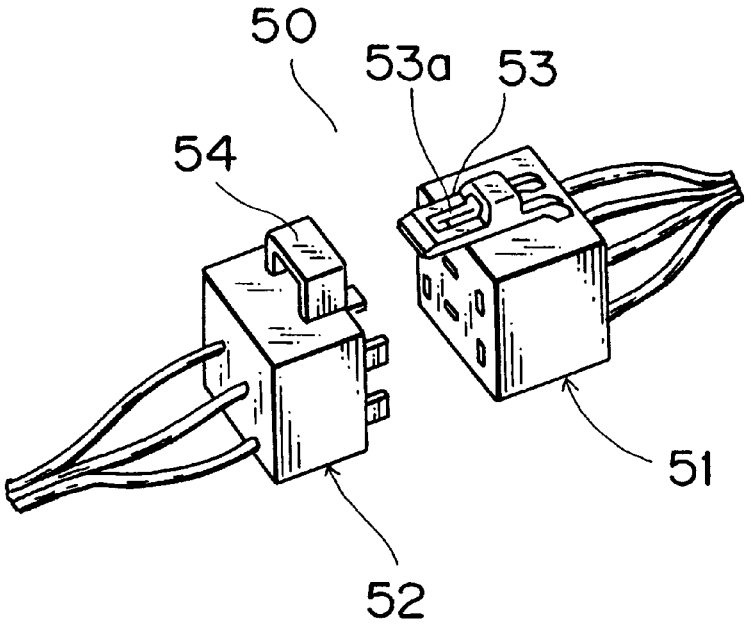
FIG. 8 PRIOR ART
FIG. 8 is an exploded perspective view showing a conventional electrical connector.
Figure 9:
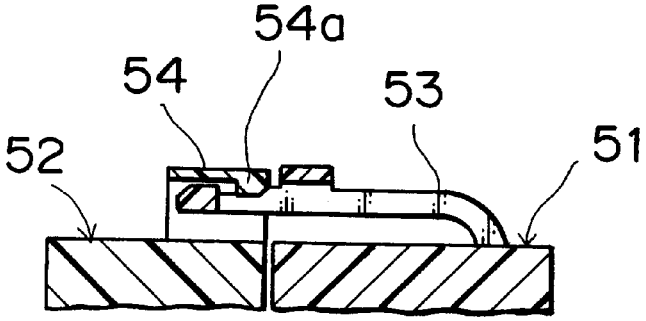
FIG. 9 PRIOR ART
FIG. 9 is a cross-sectional view which shows the state before a locking projection and a locking hole are engaged.
Figure 10:
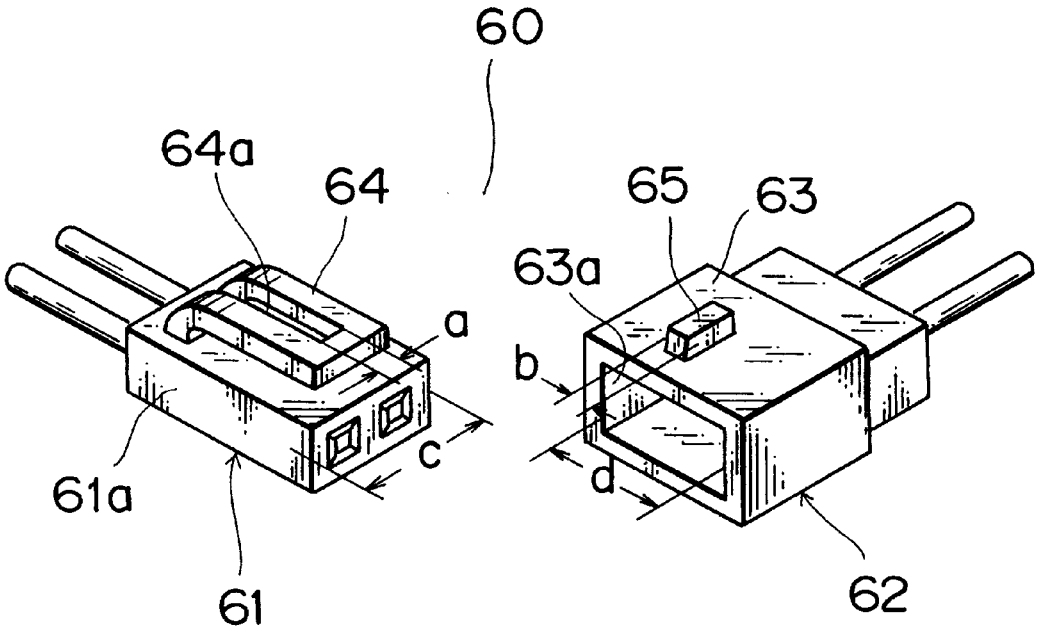
FIG. 10 PRIOR ART
FIG. 10 is an exploded perspective view showing another conventional electrical connector.
Figure 11:
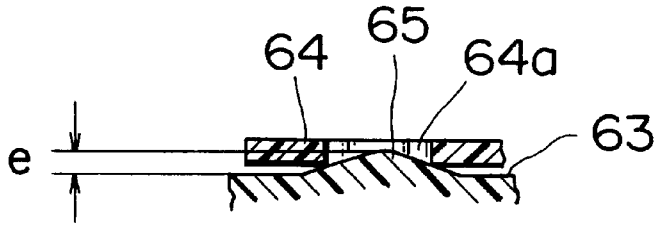
FIG. 11 PRIOR ART
FIG. 11 is a cross-sectional view showing the state that a securing projection and a securing hole are engaged.

FIG. 7 shows the second embodiment about the structure for preventing looseness of an electrical connector. Detailed explanation of the same structural member as the first embodiment will be omitted below.

In FIG. 7, this structure for preventing looseness of an electrical connector 1 includes a male housing 10 and a female housing 30. The female housing 30 has a hood 31 for accommodating the male housing 10. A locking projection 12 is mounted on the locking arm 11 of the male housing 10, a locking hole 32 is formed at the accommodating room 33 of the hood 31 (FIG. 1), and inserting guides 35*a*, 35*b* for preventing looseness are formed at the accommodating room 33.

In cross section backwardly divergent inserting guides 35*a*, 35*b* are formed in the coupling direction at the ceiling surface 33*a* of the accommodating room 33 (inner wall surfaces corresponding to the projecting side of the locking projection 12). This A spacing "A'" is set to be approximately equal to a spacing "B'" (A'≈B'), wherein the spacing "A'" is a length between both inner wall surfaces 32*a*, 32*b* of the locking hole 32 in the orthogonal direction, and the spacing "B'" is a length between both side wall surfaces of the locking projection 12 in the orthogonal direction.

When a center line G' of the hood 31 discords with a center line H' of the male housing 10 (for example, the center line H' is located on left-hand side of the center line G'), if the male housing 10 is inserted into the female housing 30, then a left-hand edge 12*a* of the locking projection 12 collides with the left-hand inserting guide 35*b* of the accommodating room 33. The locking arm 11 pushed by the left-hand inserting guide 35*b* is made to flex downward. As a tip of the locking projection 12 slides on the left-hand inserting guide 35*b* in this bending condition, the locking projection 12 enters inside the accommodating room 33. At the same time, the locking arm 11 is restored until becoming the former condition. And, the locking projection 12 and the accommodating room 32 are engaged.

What is claimed is:

1. A structure for preventing looseness of an electrical connector comprising:

a first connector housing;

a second connector housing having a hood for accommodating the first connector housing;

a locking projection mounted on a locking arm which is formed at said first connector housing; and a locking hole formed at said hood so as to be engaged with said locking projection;

wherein said first connector housing and said second connector housing are coupled with each other;

wherein said locking projection has a main body projecting perpendicular to the connector coupling direction, the main body having a tapered portion formed in each side wall of the main body so as to become progressively smaller in the projecting direction; and wherein the main body of the locking projection has an engagement dimension corresponding with said locking hole for preventing looseness between said first and second connector housings which have been completely coupled.

2. The structure for preventing looseness of an electrical connector set forth in claim 1 wherein a spacing between both lower edges of said taper portions is set to be approximately equal to a spacing between both inner wall surfaces of said locking hole, said both inner wall surfaces locating in an orthogonal direction to said coupling direction.

3. The structure for preventing looseness of an electrical connector set forth in claim 2 wherein a difference in a spacing between both upper edges of said taper portions and between both lower edges of said taper portion is larger than a difference in a spacing between both outer wall surfaces in said coupling direction of said first connector housing, and between both inner wall surfaces of said hood, said both inner wall surfaces locating on opposite side respectively.

4. A structure for preventing looseness of an electrical connector including:

a first connector housing;

a second connector housing having a hood for accommodating the first connector housing;

a locking projection mounted on a locking arm which is formed at said first connector housing; and a locking hole formed at said hood so as to be engaged with said locking projection;

said first and second connector housing being coupled with each other wherein, when being coupled, backwardly divergent inserting guides are formed on both inner wall surfaces of said hood to make said locking projection slidable, said both inner wall surfaces being located on an opposite side to said locking projection; and wherein the main body of the locking projection has an engagement dimension corresponding with said locking hole for preventing looseness between said first and second connector housings which have ben completely coupled.

5. The structure for preventing looseness of an electrical connector set forth in claim 4 wherein a width of said locking hole in an orthogonal direction to said coupling direction is set to be approximately equal to a width of said locking projection in said orthogonal direction.

* * * * *